US011348596B2

(12) United States Patent
Daido et al.

(10) Patent No.: US 11,348,596 B2
(45) Date of Patent: May 31, 2022

(54) VOICE PROCESSING METHOD FOR PROCESSING VOICE SIGNAL REPRESENTING VOICE, VOICE PROCESSING DEVICE FOR PROCESSING VOICE SIGNAL REPRESENTING VOICE, AND RECORDING MEDIUM STORING PROGRAM FOR PROCESSING VOICE SIGNAL REPRESENTING VOICE

(71) Applicant: Yamaha Corporation, Shizuoka (JP)

(72) Inventors: Ryunosuke Daido, Shizuoka (JP); Hiraku Kayama, Shizuoka (JP)

(73) Assignee: YAMAHA CORPORATION, Shizuoka (JP)

( * ) Notice: Subject to any disclaimer, the term of this patent is extended or adjusted under 35 U.S.C. 154(b) by 21 days.

(21) Appl. No.: 16/945,615

(22) Filed: Jul. 31, 2020

(65) Prior Publication Data

US 2020/0365170 A1 Nov. 19, 2020

Related U.S. Application Data

(63) Continuation of application No. PCT/JP2019/009218, filed on Mar. 8, 2019.

(30) Foreign Application Priority Data

Mar. 9, 2018 (JP) ..... JP2018-043115

(51) Int. Cl.
*G10L 21/057* (2013.01)
*G10L 25/90* (2013.01)
(Continued)

(52) U.S. Cl.
CPC ..... *G10L 21/057* (2013.01); *G10L 13/033* (2013.01); *G10L 13/0335* (2013.01);
(Continued)

(58) Field of Classification Search
CPC ... G10L 13/04; G10L 13/033; G10L 13/0335; G10L 21/04
See application file for complete search history.

(56) References Cited

U.S. PATENT DOCUMENTS 4,435,832 A * 3/1984 Asada ..... G10L 21/04 704/262
5,642,470 A * 6/1997 Yamamoto ..... G10L 13/033 704/258

(Continued)

FOREIGN PATENT DOCUMENTS

JP 2014002338 A 1/2014
WO 2009044525 A1 4/2009

OTHER PUBLICATIONS

International Search Report in PCT/JP2019/009218, dated Apr. 16, 2019.

*Primary Examiner* — Shaun Roberts
(74) *Attorney, Agent, or Firm* — Global IP Counselors, LLP

(57) ABSTRACT

A voice processing method realized by a computer includes compressing forward a first steady period of a plurality of steady periods in a voice signal representing voice, and extending forward a transition period between the first steady period and a second steady period of the plurality of steady periods in the voice signal. Each of the plurality of steady periods is a period in which acoustic characteristics are temporally stable. The second steady period is a period immediately after the first steady period and has a pitch that is different from a pitch of the first steady period.

13 Claims, 5 Drawing Sheets

(51) Int. Cl.

| | |
|---|---|
| ***G10L 13/033*** | (2013.01) |
| ***G10L 21/04*** | (2013.01) |
| ***G10L 13/04*** | (2013.01) |
| *G10L 25/24* | (2013.01) |
| *G10L 25/93* | (2013.01) |

(52) U.S. Cl.
CPC ..... *G10L 13/04* (2013.01); *G10L 21/04* (2013.01); *G10L 25/90* (2013.01); *G10L 25/24* (2013.01); *G10L 25/93* (2013.01)

(56) References Cited

U.S. PATENT DOCUMENTS

| | | | | |
|---|---|---|---|---|
| 5,729,657 | A * | 3/1998 | Svensson | G10L 13/06 704/264 |
| 7,124,084 | B2 * | 10/2006 | Kayama | G10L 13/02 704/267 |
| 7,143,029 | B2 * | 11/2006 | Elshafei | G10L 21/04 704/211 |
| 8,457,969 | B2 * | 6/2013 | Ae | G10H 1/0091 704/268 |
| 2002/0026315 | A1 * | 2/2002 | Miranda | G10L 13/04 704/258 |
| 2004/0006472 | A1 * | 1/2004 | Kemmochi | G10L 13/033 704/269 |
| 2010/0070283 | A1 | 3/2010 | Kato et al. | |
| 2014/0006018 | A1 | 1/2014 | Bonada et al. | |
| 2015/0040743 | A1 * | 2/2015 | Tachibana | G10L 13/06 84/622 |

* cited by examiner

VOICE PROCESSING METHOD FOR PROCESSING VOICE SIGNAL REPRESENTING VOICE, VOICE PROCESSING DEVICE FOR PROCESSING VOICE SIGNAL REPRESENTING VOICE, AND RECORDING MEDIUM STORING PROGRAM FOR PROCESSING VOICE SIGNAL REPRESENTING VOICE

CROSS-REFERENCE TO RELATED APPLICATIONS

This application is a continuation application of International Application No. PCT/JP2019/009218, filed on Mar. 8, 2019, which claims priority to Japanese Patent Application No. 2018-043115 filed in Japan on Mar. 9, 2018. The entire disclosures of International Application No. PCT/JP2019/009218 and Japanese Patent Application No. 2018-043115 are hereby incorporated herein by reference.

BACKGROUND

Technical Field

The present invention relates to technology for processing voice signals representing voice.

Background Information

Various techniques for adding voice expressions such as singing expressions to voice have been proposed in the prior art. For example, Japanese Laid-Open Patent Publication No. 2014-2338 discloses technology in which each harmonic component of a voice signal is moved in a frequency domain to thereby convert the voice represented by said voice signal into a voice having a characteristic voice quality, such as a gravelly voice or a hoarse voice.

SUMMARY

However, in the technology of Japanese Laid-Open Patent Publication No. 2014-2338, there is room for further improvement from the viewpoint of generating acoustically natural voice in sections in which acoustic characteristics, such as fundamental frequency, change with time. In consideration of the circumstances described above, an object of this disclosure is to synthesize acoustically natural voice.

In order to solve the problem described above, a voice processing method according to a preferred aspect of this disclosure is realized by a computer. The voice processing method includes compressing forward a first steady period of a plurality of steady periods in a voice signal representing voice, and extending forward a transition period between the first steady period and a second steady period of the plurality of steady periods in the voice signal. Each of the plurality of steady periods is a period in which acoustic characteristics are temporally stable. The second steady period is a period immediately after the first steady period and has a pitch that is different from a pitch of the first steady period.

In order to solve the problem described above, a voice processing device according to a preferred aspect of this disclosure comprises a memory, and an electronic controller including at least one processor and configured to execute instructions stored in the memory. The electronic controller is configured to execute compressing forward a first steady period of a plurality of steady periods in a voice signal representing voice, and extending forward a transition period between the first steady period and a second steady period of the plurality of steady periods in the voice signal. Each of the plurality of steady periods is a period in which acoustic characteristics are temporally stable. The second steady period is a period immediately after the first steady period and has a pitch is that different from a pitch of the first steady period.

In order to solve the problem described above, a non-transitory recording medium according to a preferred aspect of this disclosure stores a program that causes a computer to execute a process that comprises compressing forward a first steady period of a plurality of steady periods in a voice signal representing voice, and extending forward a transition period between the first steady period and a second steady period of the plurality of steady periods in the voice signal. Each of the plurality of steady periods is a period in which acoustic characteristics are temporally stable. The second steady period is a period immediately after the first steady period and has a pitch that is different from a pitch of the first steady period.

DETAILED DESCRIPTION OF THE EMBODIMENTS

Selected embodiments will now be explained with reference to the drawings. It will be apparent to those skilled in the field from this disclosure that the following descriptions of the embodiments are provided for illustration only and not for the purpose of limiting the invention as defined by the appended claims and their equivalents.

Figure 1:
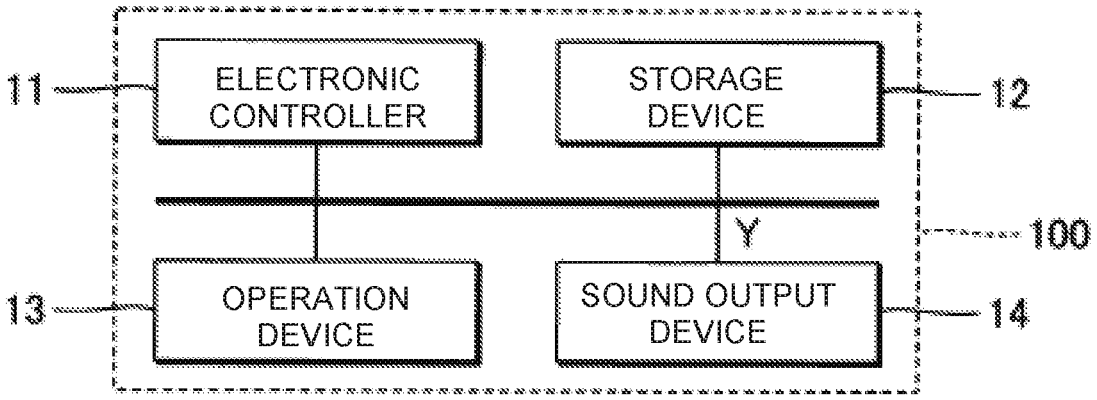
FIG. 1 is a block diagram showing a configuration of a voice processing device according to an embodiment.

FIG. 1 is a block diagram showing a configuration of a voice processing device 100 according to a preferred embodiment. The voice processing device 100 of the present embodiment is a signal processing device that adjusts the voice of a user singing a musical piece (hereinafter referred to as "singing voice").

As shown in FIG. 1, the voice processing device 100 is realized by a computer system comprising an electronic controller 11, a storage device 12, an operation device 13, and a sound output device 14. For example, a portable information terminal such as a mobile phone or a smartphone, or a portable or stationary information terminal such as a personal computer, can be used as the voice processing device 100. The operation device 13 is an input device that receives instructions from a user. For example, a plurality of operators operated by the user, or a touch panel that detects touch by the user, is suitably used as the operation device 13.

The storage device 12 is a memory which stores a program that is executed by the electronic controller 11 and various data that are used by the electronic controller 11. The storage device 12 is any computer storage device or any computer readable medium with the sole exception of a transitory, propagating signal. The storage device 12 can include nonvolatile memory and volatile memory. For example, the storage device 12 can includes a ROM (Read Only Memory) device, a RAM (Random Access Memory) device, a hard disk, a flash drive, etc. Thus, any known storage medium, such as a magnetic storage medium or a semiconductor storage medium, or a combination of a plurality of types of storage media can be freely employed as the storage device 12. For example, the storage device 12 stores a voice signal X. The voice signal X is a time domain audio signal representing a singing voice of a user singing a musical piece. Moreover, the storage device 12 that is separate from the voice processing device 100 (for example, cloud storage) can be provided, and the electronic controller 11 can read from or write to the storage device 12 via a communication network. That is, the storage device 12 may be omitted from the voice processing device 100, The term "electronic controller" as used herein refers to hardware that executes software programs. The electronic controller 11 includes one or more processors such as a CPU (Central Processing Unit), and executes various calculation processes and control processes. The electronic controller 11 can be configured to comprise, instead of the CPU or in addition to the CPU, programmable logic devices such as a DSP (Digital Signal Processor), an FPGA (Field Programmable Gate Array), and the like. The electronic controller 11 according to the present embodiment generates a voice signal Y by processing the voice signal X. The voice signal Y is an audio signal obtained by adjusting the voice signal X. The sound output device 14 is, for example, a speaker or headphones, and outputs voice represented by the voice signal Y generated by the electronic controller 11. An illustration of a D/A converter that converts the voice signal Y generated by the electronic controller 11 from digital to analog has been omitted for the sake of convenience. A configuration in which the voice processing device 100 is provided with the sound output device 14 is illustrated in FIG. 1; however, the sound output device 14 that is separate from the voice processing device 100 can be connected to the voice processing device 100 wirelessly or by wire.

Figure 2:
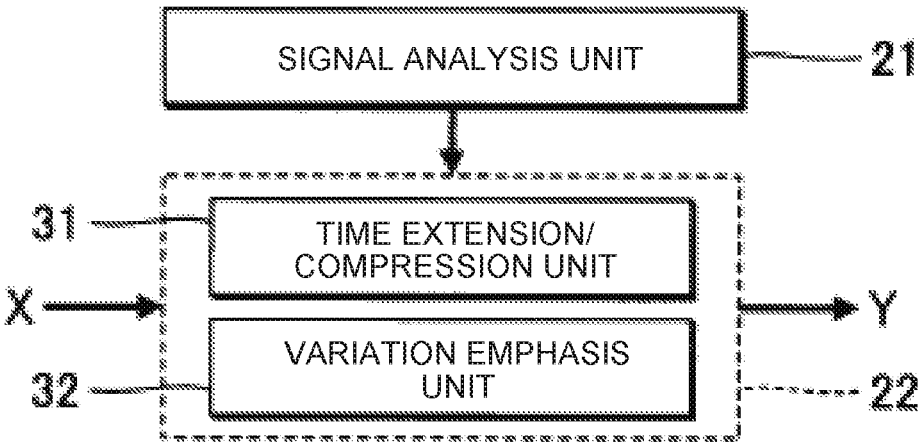
FIG. 2 is a block diagram showing a functional configuration of the voice processing device.

FIG. 2 is a block diagram showing a functional configuration of the electronic controller 11. As illustrated in FIG. 2, the electronic controller 11 realizes a plurality of functions (signal analysis unit 21 and adjustment processing unit 22) for generating the voice signal Y from the voice signal X by executing a program stored in the storage device 12 (that is, a sequence of instructions to the processor). Moreover, the functions of the electronic controller 11 can be realized by a plurality of devices configured separately from each other, or, some or all of the functions of the electronic controller 11 can be realized by a dedicated electronic circuit.

Figure 3:
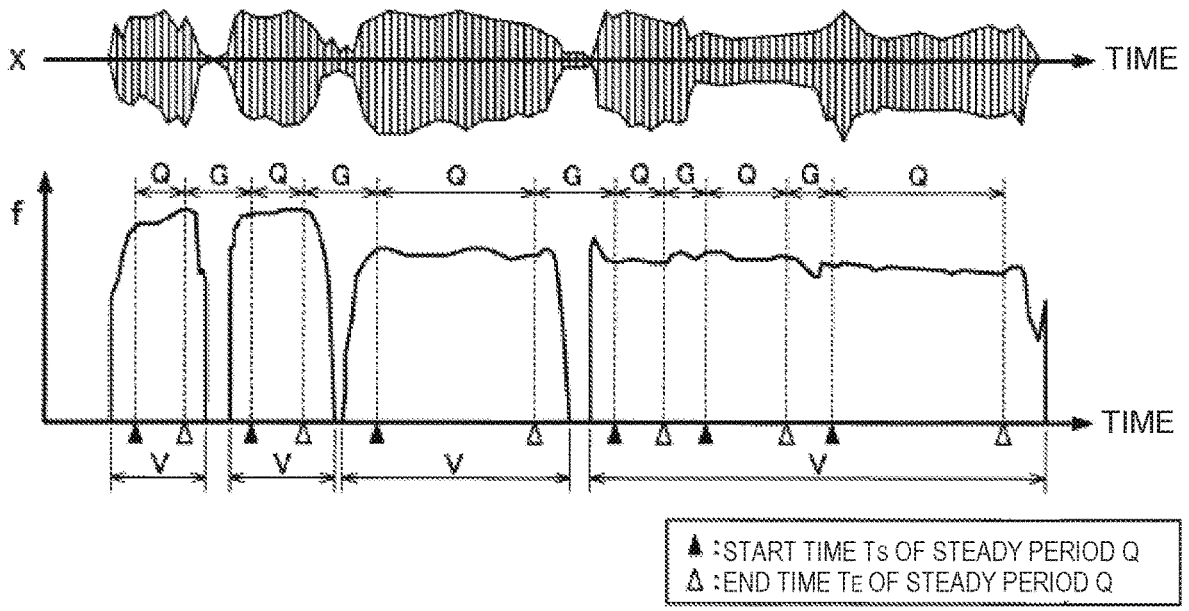
FIG. 3 is an explanatory diagram of a steady period in a voice signal.

The signal analysis unit 21 specifies a plurality of steady periods Q by analyzing the voice signal X. Each steady period Q is a period of the voice signal X in which the acoustic characteristics are temporally stable. FIG. 3 is an explanatory diagram of the steady period Q. The waveform of the voice signal X and the temporal change in the fundamental frequency f are shown side-by-side in FIG. 3. The signal analysis unit 21 specifies, as the steady periods Q, the periods in which the acoustic characteristics, including the fundamental frequency f and the spectrum shape, are temporally stable. Specifically, the signal analysis unit 21 specifies a start point TS and an end point TE for each of the steady periods Q. The fundamental frequency for the spectrum shape (that is, the phoneme) often changes between two successive notes in a musical piece. Accordingly, each steady period Q is, in other words, a period corresponding to one note in the musical piece.

Figure 4:
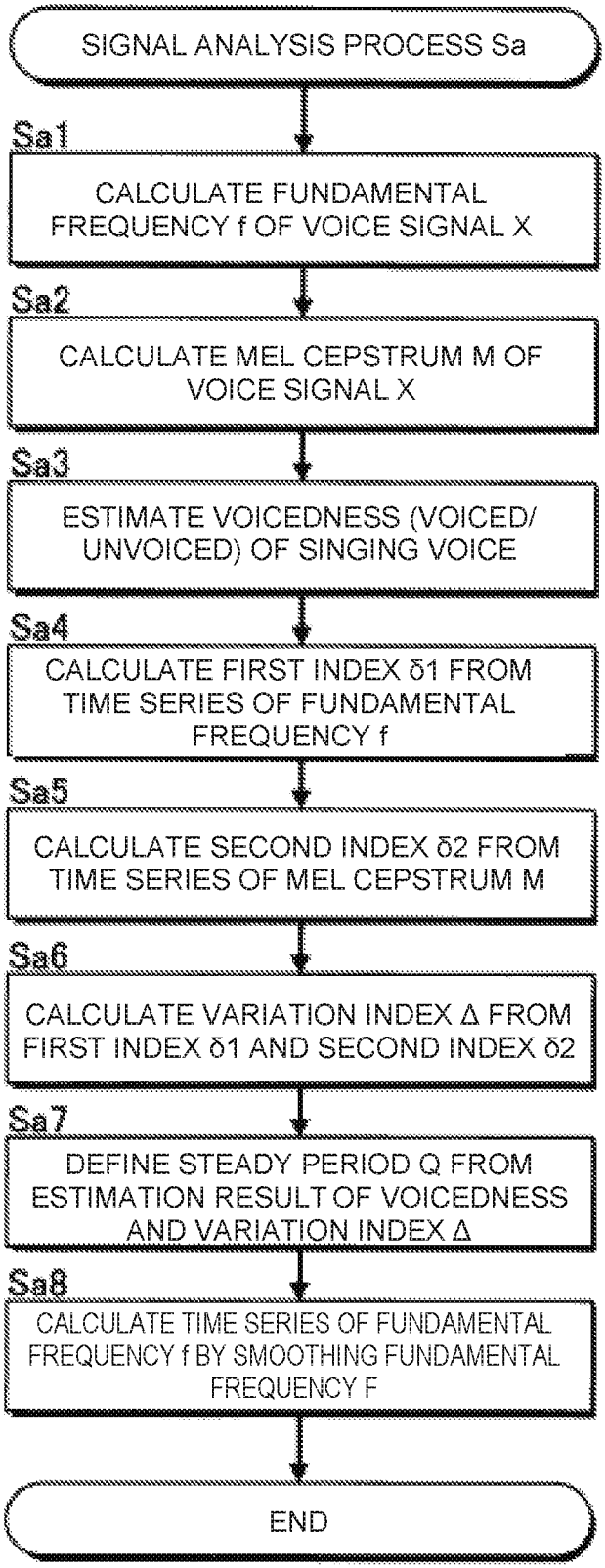
FIG. 4 is a flowchart showing a specific procedure of a signal analysis process.

FIG. 4 is a flowchart of a process (hereinafter referred to as "signal analysis process") Sa for analyzing the voice signal X carried out by the signal analysis unit 21. For example, the signal analysis process Sa of FIG. 4 is triggered by an instruction from a user to the operation device 13. As shown in FIG. 4, the signal analysis unit 21 calculates the fundamental frequency f of the voice signal X for each of a plurality of unit periods (frames) on a time axis (Sa1). Any known technique can be employed for calculating the fundamental frequency f. Each unit period is sufficiently shorter than the time length assumed for the steady period Q.

The signal analysis unit 21 calculates the mel cepstrum M, which represents the spectrum shape of the voice signal X, for each unit period (Sa2). The mel cepstrum M is expressed by a plurality of coefficients representing the envelope curve of the frequency spectrum of the voice signal X. The mel cepstrum M is also expressed as a feature amount representing the phoneme of a singing voice. Any known technique can be employed for calculating the mel cepstrum M. MFCC (Mel-Frequency Cepstrum Coefficients) can be calculated instead of the mel cepstrum M as a feature amount representing the spectrum shape of the voice signal X.

The signal analysis unit 21 estimates the voicedness of the singing voice represented by the voice signal X for each period (Sa3). That is, it is determined whether the singing voice corresponds to a voiced sound or an unvoiced sound. Any known technique can be employed for estimating voicedness (voiced/unvoiced). The order of the calculation of the fundamental frequency f (Sa1), the calculation of the mel cepstrum M (Sa2), and the estimation of voicedness (Sa3) is arbitrary, and is not limited to the order exemplified above.

The signal analysis unit 21 calculates a first index $\delta 1$ indicating the degree of the temporal change in the fundamental frequency f for each unit period (Sa4). For example, the difference between the fundamental frequencies f of two successive unit periods is calculated as the first index $\delta 1$. The more significant the temporal change in the fundamental frequency f, the larger value the first index $\delta 1$ becomes.

The signal analysis unit 21 calculates a second index $\delta 2$ indicating the degree of the temporal change in the mel cepstrum M for each unit period (Sa5). For example, a numerical value obtained by combining (for example, adding or averaging) the differences between two successive unit periods for each mel cepstrum M coefficient for a plurality of coefficients is suitable as the second index $\delta 2$. The more significant the temporal change in the spectrum shape of the singing voice, the larger the value of the second index $\delta 2$ becomes. For example, the second index $\delta 2$ becomes a large value close to the point in time at which the phoneme of the singing voice changes.

The signal analysis unit 21 calculates a variation index $\Delta$ corresponding to the first index $\delta 1$ and the second index $\delta 2$ for each unit period (Sa6). For example, the weighted sum of the first index $\delta 1$ and the second index $\delta 2$ is calculated as the variation index $\Delta$ for each unit period. The weighted value of each of the first index $\delta 1$ and the second index $\delta 2$ is set to be a prescribed fixed value, or a variable value in accordance with an instruction from the user to the operation device 13. As can be understood from the foregoing explanation, the greater the temporal variation in the mel cepstrum M (that is, the spectrum shape) or the fundamental frequency f of the voice signal X, the greater the value of the variation index $\Delta$ tends to be.

The signal analysis unit 21 specifies the plurality of steady periods Q in the voice signal X (Sa7). The signal analysis unit 21 according to the present embodiment specifies the steady periods Q in accordance with the variation index Δ and the result (Sa3) of estimating the voicedness of the singing voice. Specifically, the signal analysis unit 21 defines, as the steady periods Q, a set of unit periods in which the singing voice is estimated to be a voiced sound, and the variation index Δ falls below a prescribed threshold. Unit periods in which the singing voice is estimated to be an unvoiced sound, or the unit periods in which the variation index Δ exceeds the threshold, are excluded from the steady periods Q. The signal analysis unit 21 smooths the time series of the fundamental frequency f on the time axis to thereby calculate the time series of the fundamental frequency F.

The plurality of the steady periods Q are specified on the time axis with respect to the voice signal X by means of the signal analysis process Sa exemplified above. As shown in FIG. 3, there are cases in which a plurality of the steady periods Q are included in a series of periods (hereinafter referred to as "voiced periods") V in which the voiced sound of the singing voice continues. A period corresponding to an interval between two successive steady periods Q on the time axis is hereinbelow referred to as "transition period G." The transition period G is, with respect to two successive steady periods Q, the period from the end point TE of the former steady period Q to the start point TS of the latter steady period Q.

Figure 5:
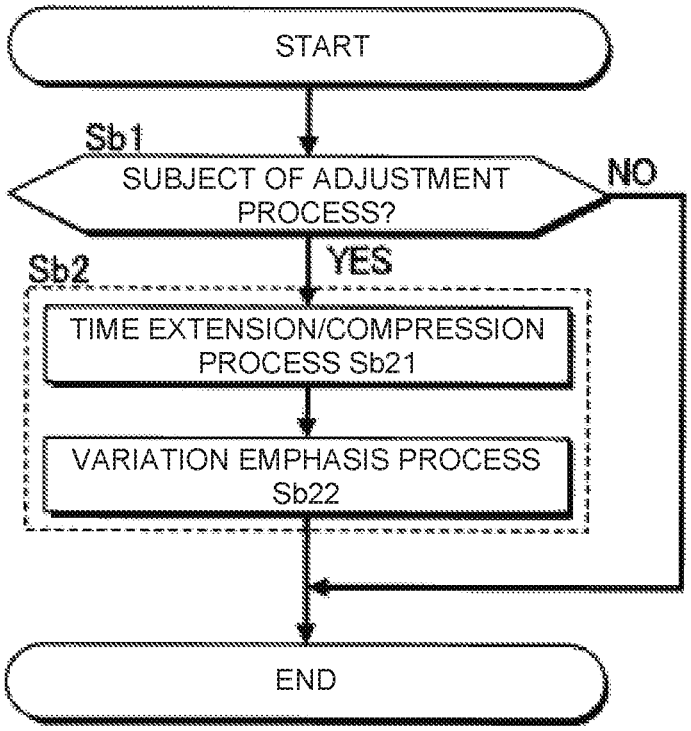
FIG. 5 is a flowchart showing a specific procedure of a process executed by an adjustment processing unit.

The adjustment processing unit 22 of FIG. 2 executes an adjustment process for each transition period G of the voice signal X. As shown in FIG. 2, the adjustment processing unit 22 according to the present embodiment includes a time extension/compression unit 31, and a variation emphasis unit 32. The time extension/compression unit 31 executes a time extension/compression (extension and compression) process for extending the transition period G on the time axis, and the variation emphasis unit 32 executes a variation emphasis process for emphasizing the variation in the fundamental frequency F within the transition period G. The adjustment process includes the time extension/compression process and the variation emphasis process. FIG. 5 is a flowchart showing the procedure of an operation carried out by the adjustment processing unit 22. The process of FIG. 5 is executed for each of the transition periods G after the completion of the signal analysis process Sa.

When the adjustment process is executed for all the transition periods G of the voice signal X, the voice signal X can be over adjusted and the reproduction sound of the voice signal Y can be perceived as a messy and annoying sound. In consideration of such circumstances, in the present embodiment, the adjustment process is executed only with respect to transition periods G that satisfy a specific condition, from among the plurality of transition periods G of the voice signal X.

When the process of FIG. 5 is started, the adjustment processing unit 22 determines whether to execute an adjustment process Sb2 (time extension/compression process Sb21 and variation emphasis process Sb22) with respect to the transition period G to be processed (Sb1). Specifically, the time extension/compression unit 31 determines that the adjustment process Sb2 is to be executed for transition periods G that satisfy one of the following conditions C1 and C2. However, the condition for determining whether to execute the adjustment process Sb2 for the transition periods G is not limited to the following examples.

Condition C1: The transition period G immediately before the steady period Q in which the pitch is the highest within the voiced period V.

(Condition C2: The transition period G in which the difference between the fundamental frequency F at the end point TE of the immediately preceding steady period Q and the fundamental frequency F at the start point TS of the immediately succeeding steady period Q exceeds a prescribed threshold.

The pitch to be taken into account for determining the Condition C1 is, for example, a representative value (for example, an average value or a median value) of the fundamental frequency F within the steady period Q. If it is determined that the adjustment process Sb2 is not to be executed for the transition period G (Sb1=NO), the adjustment processing unit 22 ends the process of FIG. 5 without executing the adjustment process Sb2 shown below.

Time Extension/Compression Process Sb21

Figure 6:
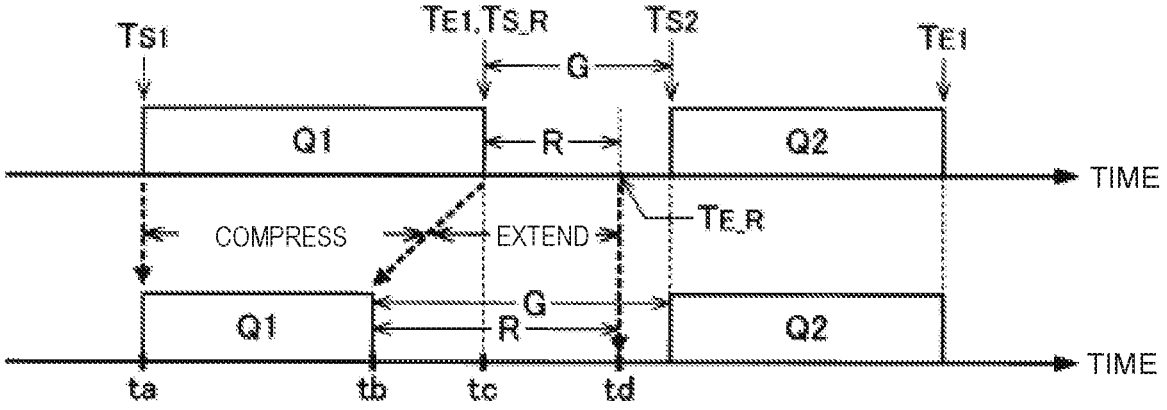
FIG. 6 is an explanatory diagram of a time extension/compression process.

If it is determined that the adjustment process Sb2 is to be executed for the transition period G (Sb1=YES), the time extension/compression unit 31 executes the time extension/compression process Sb2. FIG. 6 is an explanatory diagram of the time extension/compression process Sb21. FIG. 6 assumes a case in which the adjustment process Sb2 is executed for the transition period G between a steady period Q1 (an example of a first steady period) and a steady period Q2 (an example of a second steady period) which are successive on the time axis. The steady period Q2 is one steady period Q positioned immediately after the steady period Q1 from among the plurality of steady periods Q. The pitch is different between the steady period Q1 and the steady period Q2.

An adjustment period R shown in FIG. 6 is a part of the transition period G. A start point TS_R of the adjustment period R coincides with an end point TE1 of the steady period Q1. An end point TE_R of the adjustment period R is the time point between the end point TE1 of the steady period Q1 and a start point TS2 of the steady period Q2. Specifically, the end point TE_R of the adjustment period R is a time point preceding the start point TS2 of the steady period Q2 by a prescribed time.

In the time extension/compression process Sb21, the time extension/compression unit 31 compresses the steady period Q1 forward. The phrase "compressing the steady period forward" is defined as meaning "compressing the steady period such that the end point of the steady period is moved forward while keeping the start point of the steady period". Specifically, as shown in FIG. 6, the time extension/compression unit 31 keeps the start point TS1 of the steady period Q1 at time ta, and compresses the steady period Q1 such that the end point TE1 of the steady period Q1 moves from time tc to an earlier time tb. The time tb in FIG. 6 is a time between the time ta of the start point TS1 of the steady period Q1 and the time tc of the end point TE1 before compression. For example, the time tb is a prescribed time after the time ta, or a prescribed time before the time tc. The steady period Q1 is evenly compressed over the entire period from the start point TS1 to the end point TE1. The periodic waveform of the voiced sound is stably repeated within the steady period Q. Accordingly, instead of the even compression shown above, the steady period Q can be compressed by partially deleting the steady period Q in units of the periodic waveform.

In addition, in the time extension/compression process Sb21, the time extension/compression unit 31 extends the transition period G forward. The phrase "extending the transition period forward" is defined as meaning "extending the transition period such that the start point of the transition period is moved forward while keeping the end point of the transition period". In particular, in this embodiment, the time extension/compression unit 31 extends the adjustment period R within the transition period G forward. Specifically, as shown in FIG. 6, the time extension/compression unit 31 keeps the end point TE_R of the adjustment period Rat time td, and extends the adjustment period R such that the start point TS_R of the adjustment period R (that is, the end point TE1 of the steady period Q1) moves from the time tc to the earlier time tb. The adjustment period R is evenly extended over the entire period from the start point TS_R to the end point TE_R. With the extension of the adjustment period R described above, the transition period G is also extended forward. However, of the transition period G before extension, the period from the end point TE_R of the adjustment period R to the start point TS2 of the steady period Q2 (that is, the period other than the adjustment period R) is not extended.

As shown above, in the present embodiment, since the steady period. Q1 is compressed forward and the transition period G is extended forward, it is possible to generate an acoustically natural voice signal Y that reflects the tendency of pronunciation, in which, when changing the pitch between successive notes, the change in the pitch is prepared at the tail end portion of the preceding note. In particular, the steady period Q1 is compressed while keeping the start point TS1 of the steady period Q1, and the adjustment period R is extended while keeping the end point TE_R of the adjustment period R. Accordingly, there is the benefit that it is possible to generate an acoustically natural voice signal Y that reflects the tendency described above, without changing the start points of the steady period Q1 and the steady period Q2.

Variation Emphasis Process Sb22

Figure 7:
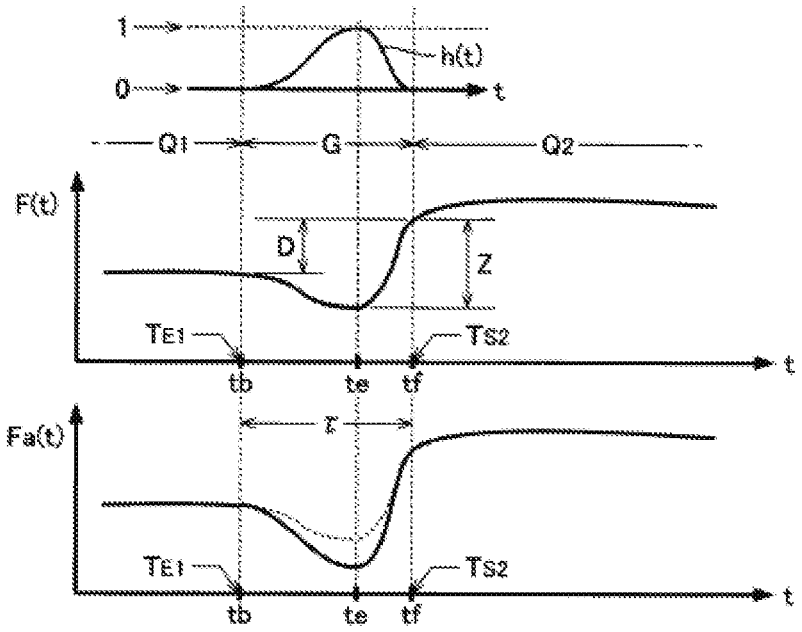
FIG. 7 is an explanatory diagram of a variation emphasis process.

When the time extension/compression process Sb21 described above ends, the variation emphasis unit 32 executes the variation emphasis process Sb22 for emphasizing the variation in the fundamental frequency F within the transition period G. FIG. 7 is an explanatory diagram of the variation emphasis process Sb22.

As shown in FIG. 7, a fundamental frequency F(t) of the voice signal X tends to monotonically decrease from the start point of the transition period G (end point TE1 of the steady period Q1) and reach a local minimum point, then to monotonically increase from said local minimum point to the end point of the transition period G (start point TS2 of the steady period Q2). The variation in the fundamental frequency F exemplified above is a singing expression that is also referred to as "bend up." In the present embodiment, the variation emphasis process Sb22 can generate an acoustically natural voice signal Y that emphasizes the tendency of pronunciation in which the fundamental frequency F fluctuates between two successive notes.

As shown in FIG. 7, the variation emphasis unit 32 converts the fundamental frequency F(t) within the transition period G to a fundamental frequency Fa(t). The fundamental frequency Fa(t) is a frequency emphasizing the temporal variation of the fundamental frequency F(t) within the transition period G. The fundamental frequency Fa(t) after conversion is calculated by the following equation (1) using a function h(t).

$$Fa(t)=F(t)-\Lambda\cdot h(t) \quad (1)$$

The function h(t) of FIG. 7 expresses a curve having a shape corresponding to the variation of the fundamental frequency F described above. For example, the function h(t) can be expressed as a combination of raised cosine functions. Specifically, as shown in FIG. 7, the function h(t) is a function that monotonically increases curvilinearly from time tb of the start point of the transition period G to time te of the local maximum point, and monotonically decreases curvilinearly from the time te to time tf at the end point of the transition period G. The time te of the local maximum point of the function h(t) is adjusted to the time of the local minimum point of the fundamental frequency F of the voice signal X.

The coefficient Λ of equation (1) is a positive number expressed by the following equation (2).

$$\Lambda=\Lambda\theta-\max(\lambda1,\lambda2,\lambda3) \quad (2)$$

The symbol max ( ) in equation (2) means an operation for selecting the maximum value from among a plurality of numerical values in the parentheses. The initial value Λθ of equation (2) is set to a prescribed positive number. The plurality of coefficients λ (λ1, λ2, λ3) of equation (2) are non-negative values (0 or positive numbers). As can be understood from equation (1) and equation (2), as the coefficient A increases, the effect of the function h(t) with respect to the fundamental frequency F(t) (decrease in the fundamental frequency F(t)) increases, resulting in the emphasis of the temporal variation of the fundamental frequency Fa(t). On the other hand, as any one of the plurality of coefficients λ (λ1, λ2 λ3) of equation (2) increases, the coefficient A becomes a smaller value. Accordingly, the degree to which the variation of the fundamental frequency Fa(t) is emphasized is decreased as one of the plurality of coefficients λ of equation (2) increases. Each coefficient λ of equation (2) is set as follows, for example.

(1) Coefficient: λ1

The variation emphasis unit 32 sets a coefficient λ1 in accordance with time length τ of the transition period G after extension by means of the time extension/compression process Sb21. Specifically, when it is determined by, for example, the variation emphasis unit 32, that the time length τ of the transition period G is shorter than (falls below) a prescribed threshold τth (first threshold), the variation emphasis unit 32 sets the coefficient λ1 to a positive number corresponding to the difference (τth−τ) between the threshold τth and the time length τ. For example, as the difference (τth−τ) between the threshold τth and the time length τ increases (that is, as the time length τ decreases), the coefficient λ1 is set to a larger value. When the time length r of the transition period G exceeds the threshold τth, the coefficient λ1 is set to 0.

As can be understood from the foregoing explanation, the variation emphasis unit 32 reduces the degree to which the variation of the fundamental frequency F(t) within the transition period G is emphasized, upon determining that the time length τ of the transition period G after extension is shorter than the threshold τth. Accordingly, when the interval between successive notes is short, it is possible to reflect on the voice signal Y the tendency of singing in which variation in the fundamental frequency within said interval is suppressed.

(2) Coefficient λ2

The variation emphasis unit 32 sets the coefficient: λ2 in accordance with the pitch difference D between the steady period Q1 and the steady period Q2. The pitch difference D is, as shown in FIG. 7, for example, the difference between the fundamental frequency F(tb) at the end point TE1 of the steady period Q1, and the fundamental frequency F(tf) at the start point TS2 of the steady period Q2. Specifically, when it is determined by, for example, the variation emphasis unit 32, that the pitch difference D is less than (falls below) a prescribed threshold Dth (second threshold), the variation emphasis unit 32 sets the coefficient λ2 to a positive number corresponding to the difference (Dth−D) between the threshold Dth and the threshold D. For example, as the difference (Dth−D) between the threshold. Dth and the threshold D increases (that is, as the pitch difference D decreases), the coefficient λ2 is set to a larger value. When the pitch difference D exceeds the threshold Dth, the coefficient λ2 is set to 0.

As can be understood from the foregoing explanation, the variation emphasis unit 32 reduces the degree to which the variation of the fundamental frequency F(t) within the transition period G is emphasized, upon determining that the pitch difference D is less than the threshold Dth. Accordingly, when the pitch difference between successive notes is small, it is possible to reflect on the voice signal Y the tendency of singing in which variation in the fundamental frequency between the notes is suppressed.

(3) Coefficient λ3

The variation emphasis unit 32 sets a coefficient λ3 in accordance with a variation (variation amount) Z of the fundamental frequency F within the transition period G. As shown in FIG. 7, the variation Z is the difference between the maximum value and the minimum value of the fundamental frequency F within the transition period G. Specifically, when it is determined by, for example, the variation emphasis unit 32, that the variation Z is less than (falls below) a prescribed threshold Zth (third threshold), the variation emphasis unit 32 sets the coefficient λ3 to a positive number corresponding to the difference (Zth−Z) between the threshold Zth and the variation Z. For example, as the difference (Zth−Z) between the threshold Zth and the variation Z increases (that is, as the variation Z decreases), the coefficient λ3 is set to a larger value. When the variation Z exceeds the threshold Zth, the coefficient λ3 is set to 0.

As can be understood from the foregoing explanation, the variation emphasis unit 32 reduces the degree to which the variation of the fundamental frequency F(t) within the transition period G is emphasized, upon determining that the variation Z of the fundamental frequency F is less than the prescribed threshold Zth. Accordingly, the probability of an extreme change in the degree of variation of the fundamental frequency within the transition period G before and after the variation emphasis process Sb22 is reduced.

The voice signal Y generated by means of the variation emphasis process Sb22 and the time extension/compression process Sb21 described above is supplied to the sound output device 14, to thereby output the voice.

MODIFIED EXAMPLE

Specific modified embodiments that are added to each aspect exemplified above are illustrated below. Two or more embodiments arbitrarily selected from the following examples can be appropriately combined as long as they are not mutually contradictory.

(1) In the embodiment described above, the steady period Q1 is evenly compressed over the entire period, but the degree of compression of the steady period Q1 can be changed in accordance with the position within the steady period Q1. Moreover, in the above-described embodiment, the adjustment period R is evenly extended over the entire period, but the degree of extension of the adjustment period R can be changed in accordance with the position of within the adjustment period R.

(2) In the above-described embodiment, both the time extension/compression process Sb21 and the variation emphasis process Sb22 are executed, but either the time extension/compression process Sb21 or the variation emphasis process Sb22 may be omitted. In addition, the order of the time extension/compression process Sb21 and the variation emphasis process Sb22 can be reversed.

(3) In the above-described embodiment, a variation index Δ calculated from a first index δ1 and a second index δ2 is used to specify the steady period Q of the voice signal X, but the method of specifying the steady period Q in accordance with the first index δ1 and the second index δ2 is not limited to the foregoing example. For example, the signal analysis unit 21 specifies a first provisional period in accordance with the first index δ1 and a second provisional period in accordance with the second index β2. The first provisional period is, for example, a period of voiced sound in which the first index δ1 falls below a threshold. That is, the period in which the fundamental frequency f is temporally stable is specified as the first provisional period. The second provisional period is, for example, a period of voiced sound in which the second index δ2 falls below a threshold. That is, the period in which the spectrum shape is temporally stable is specified as the second provisional period. The signal analysis unit 21 specifies as the steady period Q the period in which the first provisional period and the second provisional period overlap with each other. That is, the period of the voice signal X in which the fundamental frequency f and the spectrum shape are both temporally stable is specified as the steady period Q. As can be understood from the foregoing explanation, calculation of the variation index Δ may be omitted when specifying the steady period Q.

(4) In the above-described embodiment, the period of the voice signal X in which the fundamental frequency f and the spectrum shape are both temporally stable is specified as the steady period Q, but the period of the voice signal X in which either the fundamental frequency for the spectrum shape is temporally stable can be specified as the steady period Q.

(5) In the embodiment described above, the voice signal X representing the singing voice sung by the user of the voice processing device 100 is processed, but the voice representing the voice signal X is not limited to a singing voice of the user. For example, the voice signal X synthesized by means of a known piece splicing type or statistical model type voice synthesis technology can be processed instead. Moreover, the voice signal X read from a storage medium, such as an optical disc, can be processed.

(6) The function of the voice processing device 100 according to the above-described embodiment is, as described above, realized by one or more processor executing instructions (program) stored in the memory. The foregoing program can be provided in a form stored in a computer-readable storage medium and installed in a computer. The storage medium is, for example, a non-transitory storage medium, a good example of which is an optical storage medium (optical disc) such as a CD-ROM, but can include storage media of any known format, such as a semiconductor storage medium or a magnetic storage medium. Non-transitory storage media include any storage medium that excludes transitory propagating signals and does not exclude volatile storage media. In addition, in a configuration in which a distribution device distributes the program via a communication network, a storage device that stores the program in the distribution device corresponds to non-transitory storage medium.

Additional Statement

For example, the following configurations can be understood from the embodiments exemplified above.

A voice processing method according to a preferred aspect (first aspect) comprises, with respect to voice signals representing voice, compressing forward a first steady period from among a plurality of steady periods, in which the acoustic characteristics are temporally stable, and extending forward a transition period between the first steady period and a second steady period, which is, from among the plurality of steady periods, the period immediately after the first steady period and in which the pitch is different from the first steady period. In the aspect described above, since the first steady period of the voice signal is compressed forward and the transition period is extended forward, it is possible to generate an acoustically natural voice signal that reflects the tendency of pronunciation, in which, when changing the pitch between two successive steady periods, the change in the pitch is prepared at the tail end portion of the preceding steady period.

In a preferred example (second aspect) of the first aspect, when compressing the first steady period, an end point of the first steady period is moved forward while keeping a start point of the first steady period, and when extending the transition period, with respect to an adjustment period within the transition period between an end point of the first steady period and a time point preceding a start point of the second steady period, the start point is moved forward while keeping the end point. In the aspect described above, the first steady period is compressed while keeping the start point of the first steady period, and the adjustment period is extended while keeping the end point of the adjustment period within the transition period. Accordingly, it is possible to generate a voice signal that reflects the above-described tendency, in which the change in the pitch is prepared at the tail end portion of the preceding steady period, without changing the start point of pronunciation corresponding to each of the first steady period and the second steady period, In a preferred example (third aspect) of the first aspect or the second aspect, temporal variation of a fundamental frequency within the transition period after the extension is emphasized. According to the aspect described above, it is possible to generate an acoustically natural voice signal that reflects the tendency of pronunciation, in which the fundamental frequency fluctuates within the transition period.

In a preferred example (fourth aspect) of the third aspect, the degree to which the variation of the fundamental frequency within the transition period is emphasized is reduced, when a time length of the transition period after the extension falls below a threshold. According to the aspect described above, when the transition period after extension is short, it is possible to reflect on the voice signal the tendency in which variation in the fundamental frequency within the transition period is suppressed.

In a preferred example (fifth aspect) of the third aspect or a fourth aspect, the degree to which the variation of the fundamental frequency within the transition period is emphasized is reduced, when a difference between the fundamental frequency at the end point of the first steady period and the fundamental frequency at the start point of the second steady period falls below a threshold. According to the aspect described above, when the pitch difference between two successive steady periods is small, it is possible to reflect on the voice signal the tendency in which variation in the fundamental frequency within the transition period is suppressed.

In a preferred example (sixth aspect) of any one of the third to the fifth aspects, the degree to which the variation of the fundamental frequency within the transition period is emphasized is reduced, when variation of the fundamental frequency within the transition period falls below a threshold. According to the aspect described above, it is possible to reduce the possibility of excessive fluctuation of the fundamental frequency within the transition period.

A preferred aspect (seventh aspect) is a voice processing device comprising one or more processors and a memory, wherein the one or more processors execute instructions stored in the memory, to thereby, with respect to voice signals representing voice, compress forward a first steady period from among a plurality of steady periods, in which the acoustic characteristics are temporally stable, and extend forward a transition period between the first steady period and a second steady period, which is, from among the plurality of steady periods, the period immediately after the first steady period and in which the pitch is different from the first steady period.

The voice processing device according to a preferred example (eighth aspect) of the seventh aspect emphasizes temporal variation of a fundamental frequency within the transition period after the extension.

A storage medium according to a preferred aspect (ninth aspect) stores a program that causes a computer to execute a time extension/compression process which, with respect to voice signals representing voice, compresses forward a first steady period from among a plurality of steady periods, in which the acoustic characteristics are temporally stable, and extends forward a transition period between the first steady period and a second steady period, which is, from among the plurality of steady periods, the period immediately after the first steady period and in which the pitch is different from the first steady period.

What is claimed is:

1. A voice processing method realized by a computer, the voice processing method comprising:

analyzing a voice signal representing voice and specifying a plurality of steady periods on a time axis of the voice signal, each of the steady periods being a period in which acoustic characteristics of the voice signal are temporally stable;

compressing forward on the time axis a first steady period of the steady periods in the voice signal; and extending forward on the time axis a transition period between the first steady period and a second steady period of the steady periods in the voice signal, the second steady period being a period immediately after the first steady period and having a pitch that is different from a pitch of the first steady period, in the compressing of the first steady period and the extending of the transition period, a start point of the first steady period and a start point of the second steady period being kept unchanged on the time axis.

2. The voice processing method according to claim 1, wherein in the compressing of the first steady period, an end point of the first steady period is moved forward from a first time to a second time that is earlier than the first time while keeping the start point of the first steady period, and in the extending of the transition period, a start point of an adjustment period, which is a period within the transition period and between the end point of the first steady period and a time point preceding the start point of the second steady period, is moved forward from the first time to the second time while keeping an end point of the adjustment period.

3. The voice processing method according to claim 1, further comprising emphasizing temporal variation of a fundamental frequency within the transition period after the extending of the transition period.

4. The voice processing method according to claim 3, wherein in the emphasizing of the temporal variation of the fundamental frequency within the transition period, a degree to which the temporal variation of the fundamental frequency within the transition period is emphasized is reduced, upon determining that a time length of the transition period after the extending of the transition period is shorter than a first threshold.

5. The voice processing method according to claim 3, wherein in the emphasizing of the temporal variation of the fundamental frequency within the transition period, a degree to which the temporal variation of the fundamental frequency within the transition period is emphasized is reduced, upon determining that a difference between a fundamental frequency at an end point of the first steady period and a fundamental frequency at the start point of the second steady period is less than a second threshold.

6. The voice processing method according to claim 3, wherein in the emphasizing of the temporal variation of the fundamental frequency within the transition period, a degree to which the temporal variation of the fundamental frequency within the transition period is emphasized is reduced, upon determining that variation amount of the fundamental frequency within the transition period is less than a third threshold.

7. A voice processing device comprising:

a memory; and an electronic controller including at least one processor and configured to execute instructions stored in the memory, the electronic controller being configured to execute analyzing a voice signal representing voice and specifying a plurality of steady periods on a time axis of the voice signal, each of the steady periods being a period in which acoustic characteristics of the voice signal are temporally stable, compressing forward on the time axis a first steady period of the steady periods in the voice signal, and extending forward on the time axis a transition period between the first steady period and a second steady period of the steady periods in the voice signal, the second steady period being a period immediately after the first steady period and having a pitch that is different from a pitch of the first steady period, in the compressing of the first steady period and the extending of the transition period, a start point of the first steady period and a start point of the second steady period being kept unchanged on the time axis.

8. The voice processing device according to claim 7, wherein the electronic controller is further configured to execute emphasizing temporal variation of a fundamental frequency within the transition period that has been extended.

9. The voice processing device according to claim 7, wherein the electronic controller is configured to execute the compressing of the first steady period, by moving forward an end point of the first steady period from a first time to a second time that is earlier than the first time while keeping the start point of the first steady period, and the electronic controller is configured to execute the extending of the transition period by moving forward a start point of an adjustment period, which is a period within the transition period and between the end point of the first steady period and a time point preceding the start point of the second steady period from the first time to the second time, while keeping an end point of the adjustment period.

10. The voice processing device according to claim 8, wherein the electronic controller is configured to reduce a degree to which the temporal variation of the fundamental frequency within the transition period is emphasized, upon determining that a time length of the transition period that has been extended is shorter than a first threshold.

11. The voice processing device according to claim 8, wherein the electronic controller is configured to reduce a degree to which the temporal variation of the fundamental frequency within the transition period is emphasized, upon determining that a difference between a fundamental frequency at an end point of the first steady period and a fundamental frequency at the start point of the second steady period is less than a second threshold.

12. The voice processing device according to claim 8, wherein the electronic controller is configured to reduce a degree to which the temporal variation of the fundamental frequency within the transition period is emphasized, upon determining that variation amount of the fundamental frequency within the transition period is less than a third threshold.

13. A non-transitory computer-readable storage medium storing a program that causes a computer to execute a process, the process comprising:

analyzing a voice signal representing voice and specifying a plurality of steady periods on a time axis of the voice signal, each of the steady periods being a period in which acoustic characteristics of the voice signal are temporally stable;

compressing forward on the time axis a first steady period of the steady periods in the voice signal; and extending forward on the time axis a transition period between the first steady period and a second steady period of the steady periods in the voice signal, the second steady period being a period immediately after the first steady period and having a pitch that is different from a pitch of the first steady period, in the compressing of the first steady period and the extending of the transition period, a start point of the first steady period and a start point of the second steady period being kept unchanged on the time axis.

* * * * *